United States Patent [19]

Meadus et al.

[11] 3,987,730

[45] Oct. 26, 1976

[54] IRON AND LEAD-CONTAINING COMPOSITE METAL SHOT

[75] Inventors: Frederick Weldon Meadus; Bryan D. Sparks; Ira E. Puddington, all of Ottawa, Canada

[73] Assignee: Canadian Patents and Development Limited, Ottawa, Canada

[22] Filed: Feb. 3, 1975

[21] Appl. No.: 546,431

Related U.S. Application Data

[63] Continuation-in-part of Ser. No. 338,563, March 6, 1973, Pat. No. 3,900,317.

[30] Foreign Application Priority Data

Mar. 4, 1974 Canada ..... 193992

[52] U.S. Cl. ..... 102/42 R; 29/1.23; 29/182; 29/182.1; 29/182.2; 29/182.3; 29/182.5; 75/200; 75/208 R; 75/211; 75/212; 75/223; 75/224; 102/92.2

[51] Int. Cl.[2] ..... F42B 7/00; B22F 3/16; B22F 7/00; B22F 7/04

[58] Field of Search ..... 29/182, 182.2, 182.3, 29/1.23, 182.1, 182.5; 75/211, 200, 208 R; 102/42 R, 92.2

[56] References Cited

UNITED STATES PATENTS

| | | | |
|---|---|---|---|
| 2,033,240 | 3/1936 | Hardy | 29/182.2 |
| 3,301,642 | 1/1967 | Youssef | 29/182.2 |
| 3,363,561 | 1/1968 | Irons | 102/42 R |
| 3,463,637 | 8/1969 | Foerster | 75/.5 R |
| 3,664,824 | 5/1972 | Meadus et al. | 75/.5 R |
| 3,900,317 | 8/1975 | Meadus et al. | 75/211 |

FOREIGN PATENTS OR APPLICATIONS

| | | | |
|---|---|---|---|
| 1,094,780 | 12/1960 | Germany | 29/182.2 |
| 3,822,452 | 10/1963 | Japan | 29/182.2 |

*Primary Examiner*—Benjamin R. Padgett
*Assistant Examiner*—T. S. Gron
*Attorney, Agent, or Firm*—Alan A. Thomson

[57] ABSTRACT

Composite metal articles of high density are made from iron and lead or a lead-rich alloy in proportions suitably of about 25 to about 90 wt. % iron, when present up to about 5 wt. % of a lead alloy-forming element aiding wetting of the iron, and the balance substantially all lead. Preferably copper, zinc, tin, indium or mixtures thereof are present to aid wetting the iron phase.

Composite bird shot, for instance, is prepared e.g. by matrix formation and infiltration, or by agglomeration techniques, or by other techniques, with, if desired, a final mechanical shaping or compaction. The presence of iron has been found to cause a significant reduction in toxicity to birds on ingestion.

13 Claims, 3 Drawing Figures

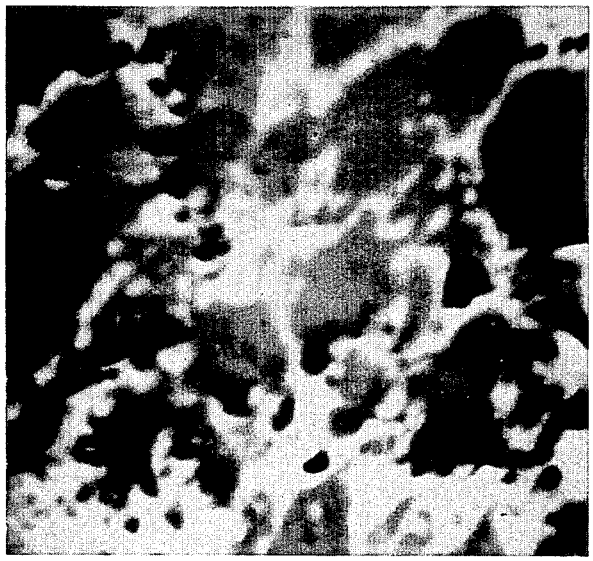
FIG. 1 COMPOSITE PELLET CROSS-SECTION 1000X
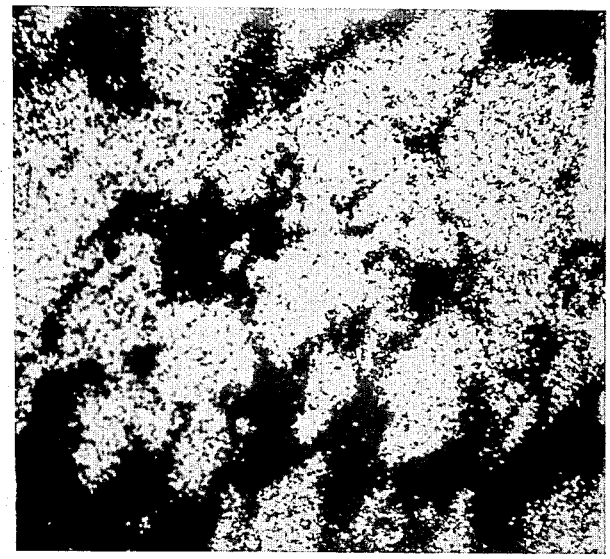
FIG. 2 COMPOSITE PELLET CROSS-SECTION (IRON PROFILE) 1000X

IRON AND LEAD-CONTAINING COMPOSITE METAL SHOT

REFERENCE TO RELATED APPLICATION

This application is a continuation-in-part of Ser. No. 338,563 filed Mar. 6, 1973 now U.S. Pat. No. 3,900,317 issued Aug. 19, 1975.

FIELD OF INVENTION

This invention is directed to iron and lead-containing composite metal articles and to particular methods of preparing these articles. A composite of particular interest is bird shot of reduced toxicity compared to the commonly used lead shot.

Other shaped articles of the composite metals can be made e.g. by the infiltration of an iron matrix or by powder interpenetration techniques. For instance the articles may be bearings, magnets, blanks for preparing porous Pb alloy objects, etc. A stronger and less expensive radiation screening, ballasting or weighting material than lead itself would be useful in many applications.

PRIOR ART

A serious problem of lead poisioning has been found to exist with respect to waterfowl and gamebirds due to the ingestion of spent shot during feeding. The shot is retained in the gizzard and is ground and eroded by the gizzard motion and acid content, releasing soluble lead into the system. Even one pellet has been found sufficient to cause death, usually within 20 days. The lead shot is very stable to corrosion and weathering under normal marsh and soil conditions and where gunning has occurred repeatedly, the density of spent shot and the resulting toxicity hazard can become very high.

Efforts are being made to develop a non-toxic or less-toxic birdshot and a number of metals, alloys and coated pellets have been tried. Iron shot has received the main emphasis since the toxicity due to iron is low (about 12 percent compared to greater than 90% mortality for lead). However, iron causes undue wear on gun barrels and chokes and ballistic behaviour beyond about 40 yards becomes poor. Lead alloys have been tried but toxicity remains unacceptably high. Copper, zinc and some other metals have been tested but while toxicity is decreased they are otherwise inferior to or less suitable than lead. Plastic-coated lead shot has had a high mortality close to that of lead itself.

Thus there is a need to develop a shot which will have acceptably low toxicity, acceptable gun barrel and ballistic performance and yet be of reasonable cost and easily made.

Metal shot has usually been prepared by some manner of disruption of metal into particles followed by cooling and shaping the particles in a moving fluid or in a disc mill etc. Shot towers of considerable size have been required. Pellets have been prepared from fine metal powders by mixing with a volatile binder and tumbling in the presence of a small amount of moisture to give balls which are then heated to remove the binder and to sinter the metal powder. In this latter case, the binder is an added cost and the density and sphericity are difficult to control and optimize.

SUMMARY OF INVENTION

In accordance with the present invention we have found that high density composites having advantages compared to lead or lead alloys alone can be prepared from certain iron and lead-containing mixtures. The composite metal article has a separate heterogeneous iron phase which may be in the form of a porous matrix, with lead or a lead-base alloy substantially filling the remainder of the volume. Small amounts, e.g. up to about 5% wt. based on the composite, of one or more elements forming an alloy with lead and aiding the wetting and coating of the iron phase are preferably incorporated. The iron phase most suitably constitutes about 25 to about 90% wt. of the composite.

The composite has particular application as pellets or bird shot. Density is sufficiently high to give reasonable ballistic performance and gun barrel and choke wear is within acceptable limits. Tests using our shot have demonstrated that the addition of iron to lead shot reduces the toxicity more than expected from the decrease in lead content. Addition of as little as about 25% wt. iron produces a shot that is no longer unacceptably toxic. For example, see Proceedings of the Sixty-Third Convention of the International Association of Game, Fish and Conservation Commissioners (Disney World Florida) September 1973 VI Report on Non-Toxic Shot p. 87-91 especially page 90. The mechanism of how the iron reduces the toxicity is not understood but it may involve fixation of lead in insoluble form by oxides of the iron (see Hildebrand et al "Lead Fixation by Iron Oxides" Naturwissenschaften 61 (1974) pages 169-170).

Iron and lead have no mutual solubility so that alloy formation is very difficult, if not impossible. Alloying elements are costly, but alloying the lead with small amounts of ternary or quaternary etc. additions which aid the coating of the iron phase has been found most satisfactory and is preferred.

The composite can be prepared by any method which allows intimate mixing and contact of the iron by molten lead or lead alloy. A dispersion of powders can be prepared, shaped and compacted, and sintered preferably with a final mechanical compaction. Current methods of forming pellets including shot tower techniques, or modified techniques that form shot in shorter vertical distances, may be adapted to form the composite pellets. However, a preferred method has been developed in which a porous matrix of iron is preformed and then infiltrated with the molten lead or lead alloy, preferably followed by a final mechanical shaping and compaction.

In the attached drawings:

FIG. 1 is a photomicrograph of a cross-section of a typical composite article according to the invention taken at 1000 X, and FIG. 2 is a photomicrograph taken using an electron probe adapted to give a profile analysis of the iron component of the same cross-section as in FIG. 1, at 1000 X.

DESCRIPTION AND EMBODIMENTS OF THE INVENTION

Figure 3:
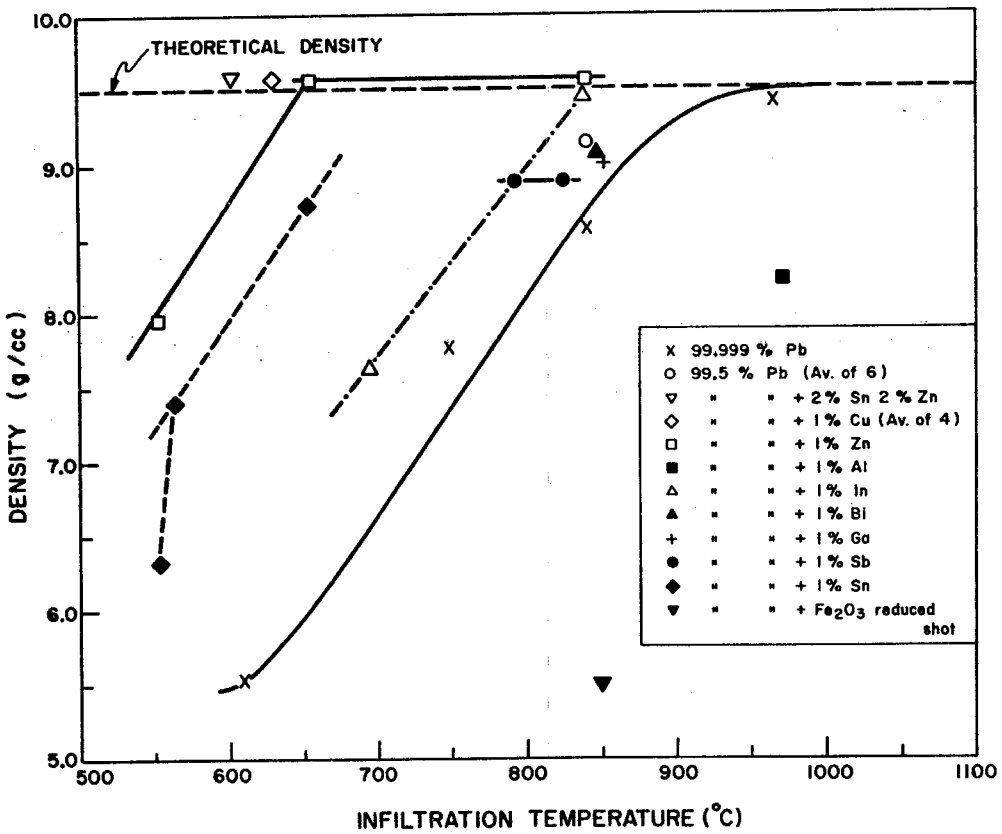
FIG. 3 is a graph showing the effect of temperature and alloying additives on density of the composite (see Example 16).

The composite metal articles comprise a separate iron phase which may be as discrete occlusions or as a more continuous matrix structure, with optionally up to about 5 wt.% of a lead-soluble element or mixtures thereof which aids wetting of the iron surfaces, and the balance substantially all lead (except for impurities).

The iron phase is most suitably about 25 to about 90 wt. % of the composite, and for bird shot this range is preferably about 40 to 70%. Zinc and copper are preferred alloying additives in up to about 1.5 wt. %. Other alloying additives such as tin and indium have been found useful but these examples are not limiting. Any element having solubility in lead, an affinity for or ability to wet iron, and a melting point below the temperature used to combine the lead and iron will aid the combination or interpenetration of the lead and iron. Even small amounts of such additives will show some effect e.g. about 0.05%, but this lower limit is not critical. Cost and other factors would indicate decreased benefit above about 5% with not more than about 1.5% usually being adequate. However, the presence of these iron wetting aids is not necessary since increasing the temperature can effect the same result. Thus substantially complete interpenetration can be achieved above about 950° C without specific additives. If some voids can be tolerated this temperature can be lowered (for example see FIG. 3).

The final cross-section is not uniform i.e. the iron remains a distinct separate phase as can be seen in the accompanying photomicrographs (using a pellet as in Example 2(a) below). The photomicrograph shown as FIG. 1 was obtained from an electron scanning microscope using a conventional configuration. The pellets were set in epoxy resin, carefully sectioned and polished. The overall structure appears largely as iron phase shown dark grey in FIG. 1 – imbedded in an alloy of Pb, Sn and Zn-shown as white. FIG. 2 was obtained using the electron probe attachment to give a profile analysis of the iron of the same cross-section. In FIG. 2 the iron appears as the light-colored areas. Similar photomicrographs were taken with the probe for Pb, Sn and Zn separately. The Pb, Sn and Zn were seen to lie between the iron phase and served to fill the voids and and cement the iron phase together. On superimposing these photomicrographs (as negatives) on top of each other one sees that the iron is not alloyed except possibly at the iron surfaces with the Pb, Sn and Zn. There are also indications that n is preferentially adsorbed at the iron interface.

Impurities in the lead are usually of some benefit in aiding interpenetration or wetting of the iron phase (see FIG. 3). Thus high purity grades of lead are not essential in this invention. Considerable impurities can be tolerated in the iron phase - satisfactory results have been obtained with up to about 3% of the iron phase as silica/silicates (see Example 9). Carbon, particularly at the iron surfaces, has a detrimental effect (see Example 15). Iron oxides or iron ore concentrates have been used to form the iron phase with reduction to iron being carried out before contact with the lead phase.

The composite can be formed inter alia by intermingling powders, shaping and sintering (usually followed by a final compaction) e.g. as outlined in our U.S. Application 338,563 referred to above. However, it has been found desirable to preform the iron phase as a porous matrix, and infiltrate this matrix with the lead phase in molten condition. The lead phase can be layered onto the iron matrix and the coated matrix heated until infiltration of the molten lead occurs. Alternatively the iron matrix can be immersed in, sprayed with or otherwise contacted with the molten lead phase at a temperature sufficient to effect the desired infiltration. The iron matrix can be continuous as a sheet, rod, tube, etc. which is fed continuously into contact with the molten lead phase, and final shaping carried out on the composite or portions thereof. Porous iron matrix formation, infiltration with molten lead, and molding to final shape is a preferred technique for forming the composite article.

Where sufficient molten lead is to be used to form a fluid system with the iron phase in discrete form, modified shot tower techniques or extrusion into a bath, could be used such that surface tension effects will serve to shape the composite.

According to a preferred aspect of the invention, the composite is formed by a process comprising:

a. providing an iron or iron oxide phase in one of particulate and porous matrix forms;

b. intermingling said phase with a lead phase in one of particulate and molten forms:

c. reducing any iron oxide to iron and intimately contacting the iron surfaces with the lead phase while in a molten state, at a selected temperature sufficient to substantially penetrate, coat and surround the iron with the lead phase, cooling and d. recovering a dense iron-lead composite. The most preferred process includes the steps of compacting and shaping iron-containing subdivided material selected from iron and iron oxides to provide a porous matrix structure; and heating said matrix to reduce any iron oxide to iron and contacting with a molten lead phase at a temperature sufficient to effect infiltration of the lead phase into the iron matrix structure. The selection of the temperature for interpenetration of the iron and lead to give high densities close to theoretical is important. In the absence of signigicant alloying additives aiding wetting of the iron phase, temperatures in excess of about 950° C are necessary. With selected alloying elements this temperature can be reduced considerably. The minimum temperature giving substantially theoretical density for each system can readily be determined by testing. A compromise based on economic considerations is usually made between use of lower temperatures and higher cost alloying additives. Temperatures as low as about 500° C gave good results (see Ex. 8). With some lead alloys melting as low as about 320° C, still lower temperatures are possible.

For shot pellets of good ballistic performance as high a density as possible is desired and substantially complete infiltration or sintering is necessary to achieve high density and strength. The alloying additives and the infiltration or sintering temperature affect the resulting density. Temperatures over about 1200° C are usually deemed too costly for this type of product. Quite high densities have been achieved at infiltration or sintering temperatures below 1200° C, as evident in the Examples below.

One auxiliary step which has been found to increase the density where interpenetration is incomplete is to impact, repeatedly hammer or roll the infiltrated or sintered pellets with hard surfaces. One convenient way of accomplishing both densification and shaping is to agitate pellets in a closed partially-filled container in a 3-dimensional path to effect repeated ricocheting impacts with the container walls. Another preferred technique is to roll the pellets between hard surfaces e.g. between rotating grooved plates being urged together. For example the final densities of balls were greatly improved by rolling the sintered balls, under pressure, between two hard steel, flat or grooved plates. The density of Pb, Fe, Sn and Zn sintered shot was increased from 8.05 to 9.08 by this method (theoretical density 9.50 g/cc.)

The incorporation of the alloying elements can be varied — it is only necessary that the elements be present when the molten lead contacts the iron surfaces. It is usually convenient to add the elements to the molten lead i.e. preform the lead alloy. However the alloying element may first be applied to the iron surface before contact with the molten lead, for instance by chemical plating, deposition from the vapor phase etc.

For overall performance, cost, and toxicity, presently preferred compositions for bird shot are:

iron in about 40 to about 70 wt.;
copper or tin in about 0.05 to about 1.5% wt.;
zinc in about 0.05 to about 1.5% wt.;
and the balance substantially all lead.

The following examples are illustrative.

EXAMPLE 1

Finely divided metal powders of from about 50 to 150 micrometers diameter were mixed in a high speed blender to give a 20% wt. solids slurry in an aliphatic hydrocarbon solvent (Varsol-trademark). The metals were present in the following proportions: 55% wt. Pb, 40% Fe, 4% Sn and 1% Zn. Water containing 0.1% Wt. of tannic acid, was metered to the surface of the slurry while stirred in the blender, in an amount of about 10% wt. of the solids. Agglomerates of about 0.5 mm diameter quickly formed, and were used as nuclei.

Slurry containing a lesser concentration of nuclei in the solvent was placed in a rotating dish. A small amount of water was sprayed onto the surface of the rotating slurry and further mixed metal powder was then added. (The powder was preferably pre-wetted with solvent to minimize dusting and aid incorporation). Water was again sprayed onto the surface to give a total of about 8% by wt. based on the further powder added. A layer of powder was formed on the nuclei. This alternate powder addition and water spray was repeated a number of times to build up successive layers on the nuclei until the balls reached the size of about 3 mm. diameter. The balls at this stage should be about 14% larger than the final desired shot size.

The balls were separated from the solvent by screening and air dried slowly. They were sintered by heating slowly in an inert atmosphere up to about 940° C over 1.5 hours and held at this temperature for about 15 min. The balls were packed in graphite powder which maintained a reducing atmosphere around the charge. (Hydrogen atmospheres have also given good sintering). The sintered balls were cooled in a reducing or inert atmosphere. A sintered density of 7.5 g/cc was obtained, and a diameter of about 2.6 mm.

The lead content of each powder addition during the multi-layering operation can be increased to give lead-rich surface layers.

EXAMPLE 2

Balls were made as outlined in Example 1 containing a. 40 % wt. Pb, 55% Fe, 4% Sn and 1% Zn and
b. 30 % wt. Pb, 65% Fe, 4% Sn and 1% Zn Both groups were packed in graphite powder and sintered at about 1000° C for 20 min. (a), and 1 hr. (b), followed by quick cooling in an inert atmosphere. Good balls having a density of 8.4 (a), and 7.2 (b) g/cc were obtained. One of the (a) pellets was used to obtain the photomicrographs FIGS. 1 and 2.

Large samples of (a) and (b) pellets were tested for toxicity to birds, and for shotgun wear (300 rounds) and were found acceptable on both counts.

EXAMPLE 3

The effect of temperature on sintered density was examined for several compositions of Pb/Fe/Sn/Zn. Balls were prepared as in Example 1 having the following compositions:

a. 55% wt. Pb, 40% Fe, 4% Sn and 1% Zn.
b. 30% wt. Pb, 65% Fe, 4% Sn and 1% Zn.
c. 28% wt. Pb, 65% Fe, 4% Sn and 3% Zn.

Samples from each series were then sintered at various temperatures for 1 hour. The pellets were packed in graphite powder during sintering and cooled in an inert atmosphere.

For 3 (a), densities of 7.5–7.6 g/cc were achieved at temperatures within about 930°–1000° C. From over about 1000° C to about 1140° C, the sintered densities were lower than this with a distinct minimum at about 1050° C. Beyond 1140° C the densities increased above 7.6, with a density of 8.5 being reached at 1180° C.

With 3 (b), a distinct maximum in density occurred at about 1040°–1050° C (about 7.1 g/cc). At 1000° C and 1080° C the sintered density had dropped to about 6.6 g/cc.

With 3 (c), a maximum occurred within about 1050° to 1090° C of about 7.2 g/cc. Below and above this temperature range, the density fell off sharply. Above about 1230° C the density was increasing above 7.2.

EXAMPLE 4

Composite pellets of 55% wt. Pb, 40% Fe, 4% Cu and 1% Zn were prepared as in Example 1. Pellets were sintered for 1 hour at various temperatures (by direct introduction into the hot furnace) and the densities measured. Some sintered pellets were then compacted in a container in a high speed rotary shaker. The sintered densities increased only slightly (from 7.4 to 7.6 g/cc) as the temperature increased from about 950° C to 1150° C and there was no distinct maximum. This was in contrast to the behaviour of the Sn-containing pellets of Examples 1–3. The compacted sintered pellets had densities about 0.3–0.4 g/cc higher than the uncompacted ones. The highest density achieved was 8.2 g/cc at 1100° C where some residual carbon from the organic liquid remained with the pellets into the sintering operation.

When the pellets were heated slowly to sintering temperature (over a period of 1.5 hours), a greater increase in density was observed with increasing sintering temperature than before. Densities as high as 8.5 – 8.8 g/cc were obtained at 1140° C using the additional compaction described.

EXAMPLE 5

Composite pellets of 30% Pb, 65% Fe, 4% Cu and 1% Zn were prepared as before and sintered for 1 hour at various temperatures. The samples were introduced into the hot furnace. The density increased approximately linearly from about 5.8 g/cc at 1000° C to about 6.8 at 1200° C. With compaction after sintering, the linear increase was from about 6.6 at 1000° C to about 7.8 at 1200° C.

The pellets of Ex. 4 and 5 also gave acceptable toxicity and gun barrel wear.

The replacement of the iron particles with iron oxide, particularly ferric oxide (reagent grade or specular hematite), particles in the composite formation has been demonstrated. In this case, the iron oxide was reduced to Fe, in a furnace, prior to sintering. Sintering behaviour and ultimate densities were very satisfactory.

EXAMPLE 6

A powder mixture with the following composition was prepared:

| Feed | | On Reduction | |
|---|---|---|---|
| Pb | 63.0% | Pb | 70% |
| $Fe_2O_3$ | 32.4% | Fe | 25% |
| Sn | 3.6% | Sn | 4% |
| Zn | 1.0% | Zn | 1% |

Theoretical density of reduced material 10.3 g/cc.

The iron oxide powder was a sample of specular hematite, 99.5% pure, −270 Tyler mesh. The powder mixture was agglomerated into spheres in a 10 inch diameter dish using Varsol as the suspending medium, and a very dilute aqueous tannic acid solution as the bridging liquid. The spheres were sintered in hydrogen according to the following program: 2 hours heating to reach 1013° C, temperature maintained at 1013° C for 2 hours, and then reduced to the ambient level in ½ hour. The spheres appeared to be well reduced; a density determination gave a value of 9.5 g/cc., which is 92% of the theoretical value.

A modified process has been developed which gives a product slightly superior to that obtained by earlier examples i.e. higher density and strength. In this modification, shaped compacts or agglomerates are formed as before from iron or iron oxide powder. These compacts may then be reduced in a suitable atmosphere ($H_2$, CO, cracked ammonia, etc.) at a temperature sufficient to give only partial sintering, e.g. about 800° – 1000° C. It is important that the compacts or agglomerates retain their porous structure. The porous matrix is then intermingled with or coated with lead powder containing metal additives (e.g. Zn, Sn, Cu) and heated to allow molten lead to wet the iron surfaces. The lead powder for example can be layered onto the iron agglomerates in a second agglomeration, using standard agglomeration procedures as before. The lead-coated iron composites are heated in a reducing atmosphere at temperatures above the melting point of lead. The molten lead penetrates the porous structure of the iron matrix forming a dense, strong composite. Sufficient lead should be used to completely fill the pores but excess should be avoided.

A typical example is as follows:

EXAMPLE 7

Iron spheres, with an approximate diameter of 0.130 inch, were made from iron powder (90% −325 Tyler mesh and 99.5% Fe) in a 10 inch rotating dish, using trichloroethylene as the suspending medium and 1% aqueous ferric chloride solution as the bridging liquid. The spheres were air dried and sintered at 800° C in hydrogen. The density of the reduced spheres was 5.0 g/cc., i.e. 36% porosity.

A coating material was prepared as follows:

| | | |
|---|---|---|
| lead | 92.5% | as −325 Tyler mesh powders. |
| tin | 6.2% | |
| zinc | 1.3% | |

This mixture was layered onto the reduced iron spheres in the rotating dish with trichloroethylene as the suspending medium and a dilute solution of tannic acid as bridging liquid. After drying, the shot were heated up to 950° C in hydrogen and then cooled rapidly.

Final Composition of the spheres was:

| | | |
|---|---|---|
| iron | 54.8% | having a Theoretical Density of 9.3 g/cc. |
| lead | 41.6% | |
| tin | 2.8% | |
| zinc | 0.8% | |

Average density of the shot produced was 8.4 ± 0.2 g/cc., which is 90% of the theoretical value. Compression of these shot increased the density to 8.7 g/cc., 94% of theoretical density. The zinc powder may be left out of the original formulation, and instead incorporated from the gaseous state in the furnace during sintering.

If high temperatures for interpenetration and sintering are acceptable iron and lead per se can be used to form high density composites. For example, a uniform mixture of powders containing 60% Pb and 40% Fe was agglomerated from a dispersion in a hydrocarbon solvent with 3.5% (by wt. of the powder) of an aqueous solution containing 1% $HNO_3$ and 1% $SnCl_2$, the resulting composites interpenetrated and sintered at 1350° C in hydrogen, and balls of density 9.6 g/cc recovered. (Instead of hydrogen a reducing atmosphere produced by heating graphite with a small amount of oxygen present, also gave the same final density).

Porous iron matrices have been impregnated by a suitable molten lead alloy, e.g. by immersion of the matrix in a bath of the molten alloy. Impregnation occurs spontaneously under the right conditions of temperature and bath composition. The process is preferably carried out in a reducing atmosphere. After impregnation the matrix is removed from the bath and may be placed on a hot vibrating screen or otherwise treated to remove excess molten alloy from the surface. The final result is a dense, strong, composite substantially free of internal voids.

The final composition of the lead-iron composite can be adjusted by controlling the porosity of the iron matrix. This can be done in a number of ways: for example

1. Selecting the particle size of the powder used to form the matrix i.e. a narrow range of particle size gives a higher porosity than a broad spectrum of sizes.

2. Reduction of compacts or agglomerates made from iron oxide powder gives an iron matrix with a porosity higher than that made from iron powder.

3. Very high porosity (up to 75% voids) has been achieved by incorporating volatile or combustible components into the compacts or agglomerates which can be removed on heating, thus creating more voids.

EXAMPLE 8

Agglomerates were made from Domtar MP-81 iron powder (90% −325 mesh, 99+% Fe) and sintered at 800° C in hydrogen for ½ hour to give iron shot matrices with a density of 4.9 g/cc. Alloy impregnation melts were prepared by heating and mixing the following metal components in a reducing atmosphere until a uniform, well-reduced melt was obtained.

a. lead - 91.0% wt.; tin - 6.8% wt.; zinc - 2.2% wt. The iron shot were impregnated with the molten alloy (a) at 508° – 532° C in a reducing atmosphere. Final Density - 9.1 ± 0.2 g/cc (Theoretical density - 9.2 g/cc)

| Final Composition: | Pb | Fe | Sn | Zn |
|---|---|---|---|---|
| (Wt.%) | 47.6 | 47.7 | 3.6 | 1.1 |

The same iron shot were also impregnated at 625° – 650° C with the alloy (b) of the following composition:

b. lead - 97.3% wt.; tin - 0.3% wt.; zinc - 2.4% wt. Final Density - 8.9 ± 0.9 g/cc (Theoretical density - 9.0 g/cc)

| Final Composition: | Pb | Fe | Sn | Zn |
|---|---|---|---|---|
| (Wt.%) | 41.4 | 57.5 | 0.1 | 1.0 |

Poorer uniformity of the resulting shot suggests that about 0.3% is a preferred lower limit for tin content in this alloy (b).

EXAMPLE 9

Agglomerates were made from a magnetite ore concentrate (65% Fe, –270 mesh) from Marmora, Ontario. These agglomerates were reduced in hydrogen for 2 hours at 900° C to give iron shot with a density of 3.1 g/cc. The shot were impregnated at 700° C with an alloy of the following compositon: lead - 91.0%; tin - 6.8%; zinc - 2.2% Final Density - 9.7 ± 0.3 g/cc (Theoretical density - 9.7 g/cc)

| Final Composition: | Pb | Fe | Sn | Zn |
|---|---|---|---|---|
| (Wt.%) | 65.1 | 28.5 | 4.9 | 1.5 |

EXAMPLE 10

Agglomerates were made from a mixture (50% of each, by weight) of Domtar MP-81 iron powder and a high grade (99.5+% $Fe_2O_3$) iron oxide powder (–270 mesh). The agglomerates were reduced in hydrogen at 850° C for 1½ hours to give iron shot with a density of 3.9 g/cc. The shot were impregnated at 600° – 700° C with an alloy of the following composition: lead - 97.3%; tin - 0.5%; zinc - 2.2% Final Density - 9.5 ± 0.25 g/cc (Theoretical density - 9.7 g/cc)

| Final Composition: | Pb | Fe | Sn | Zn |
|---|---|---|---|---|
| (Wt.%) | 61.6 | 36.7 | 0.3 | 1.4 |

EXAMPLE 11

Iron oxide (99.5% $Fe_2O_3$, - 270 mesh) was coagglomerated with wood flour (17% by wt.), using 2% aqueous tannic acid as bridging liquid and Varsol as the suspending medium. The agglomerates were heated in air at 600° C for 48 hours, to remove the wood flour and create more void space. This material was then reduced in hydrogen for 2 hours at 850° C to give iron shot with a density of 2.3 g/cc.

Impregnation was carried out at 890° C with an alloy of the following composition:

lead - 97.4%; tin - 1.3%; zinc - 1.3% Final Density - 10.3 ± 0.2 g/cc (Theoretical density - 10.3 g/cc)

| Final Composition: | Pb | Fe | Sn | Zn |
|---|---|---|---|---|
| (Wt.%) | 76.8 | 21.2 | 1.0 | 1.0 |

EXAMPLE 12

An alloy was produced by heating the following components to 800° C: lead - 95.2%; copper - 2.4%; zinc - 2.4%. The metals formed two phases; a low melting, liquidus fraction and a solid. The phases were separated and the liquid fraction used for impregnation of iron shot (density 3.4 g/cc) made by the reduction of iron oxide (99.5% $Fe_2O_3$, –270 mesh). Bath temperature was 800° C. Final density was 9.6 ± 0.5 g/cc.

EXAMPLE 13

Iron shot from example 12 were impregnated at 600° C with an alloy of the following composition: lead - 97.5% zinc - 2.5% Final Density - 8.9 ± 0.6 g/cc (Theoretical density - 9.9 g/cc.)

| Final Composition | Pb | Fe | Zn |
|---|---|---|---|
| (Wt.%) | 68.3 | 30.0 | 1.7 |

The introduction of 0.2% tin into this system gave the following results:

Final Density 9.9 ± 0.2 g/cc (Theoretical density - 10.1 g/cc.)

EXAMPLE 14

Iron shot from example 12 were impregnated at 650° – 720° C with an alloy of the following composition:

lead - 98%; tin - 2% Final Density - 9.4 ± 0.5 g/cc (Theoretical density - 10.0 g/cc.)

| Final Composition: | Pb | Fe | Sn |
|---|---|---|---|
| (Wt.%) | 70.0 | 28.6 | 1.4 |

Examples 13 and 14 show that impregnation with lead-zinc and lead-tin alloys is possible but density and uniformity obtained is inferior to that found for a lead-zinc -tin alloy at comparable temperatures.

Porous iron shot containing as much as 0.225% by weight carbon (Domtar MP-81SP iron) have been infiltrated without any problems. However iron shot which have been reduced in carbon/carbon dioxide system show inferior infiltration properties.

EXAMPLE 15

Iron shot made from a mixture (50:50) of MP-81SP iron powder and hematite (Ferrox Iron 99.5% $Fe_2O_3$) were reduced by two techniques.

| Hydrogen (1½ hours at 850°C) | Carbon/$CO_2$ (4½ hrs. at 975°C) |
|---|---|
| density 3.89 ± 0.10 g/cc | density 4.78 ± 0.23 g/cc |

The two samples of iron shot were infiltrated with the following bath alloy at 800° – 850° C: Lead - 95.0%; Tin - 2.0%; zinc - 3.0% (A uniform bath mixture had previously been obtained by melting the metals in hydrogen at 600° C).

| | Hydrogen reduced | Carbon/$CO_2$ reduced |
|---|---|---|
| Density: | 9.48 ± 0.30 g/cc. (99.9% of Theoretical) | 8.32 ± 0.48 g/cc. (91.3% of Theoretical) |

Results obtained with the carbon-reduced iron were sufficiently inferior to indicate that some contamination of the iron surface had occurred. At 1000° C the solubility of carbon in iron is less than 1% but in the circumstances described the contamination would be concentrated at the iron surface where it would have the most adverse effects.

EXAMPLE 16

Iron ore as a source of iron in the preparation of the porous blanks, is of considerable interest. In this context a sample of a magnetite concentrate, from Marmora, Ontario, has been investigated (see also Example 9). The oxide was agglomerated and then reduced in hydrogen. The iron shot produced had the following approximate composition: - 93.5% -Fe 6.5% - Silica/-Silicates. After reduction at close to 1000° C the silicates were presumably present in combination with the iron. Another sample of the magnetite ore was beneficiated to remove some of the silica. This material was then agglomerated and reduced as before. The composition was then approximately as follows: - 98.0% Fe; 2.0% Silica/Silicates.

The two samples of porous, iron blanks were then infiltrated at 700° C with an alloy of the following composition: - Lead - 91.0%; Tin - 6.8%; Zinc - 2.2%. The densities of the infiltrated shot were as follows: -

| 6.5% Silica/Silicates | 2.0% Silica/Silicates |
|---|---|
| 8.7 g/cc (91% of Theoretical) | 9.5 g/cc (97.4% of Theoretical) |

It is obvious that increasing amounts of silica impurities cause a decrease in the effectiveness of infiltration of lead into iron.

EXAMPLE 17

Tests have been carried out with several grades of lead without further addition of wetting aids. The results are shown on the attached graph FIG. 3. These data were obtained using porous iron shot, density 4.56 ±0.15 g/cc, made from Domtar MP-81SP iron powder. The results demonstrate that the infiltration is temperature dependent. Infiltration can be achieved even with 99.999% (nominally) lead without additives if the temperature is high enough, ~960° C in this case. Less pure lead requires lower temperatures for satisfactory infiltration, e.g. about 850° C for 99.5% lead. It is possible the infiltration occurs at the lower temperature because of the presence of small amounts of wetting elements as impurities. The concentration of wetting additives, needed to promote infiltration to a noticeable extent would appear to be quite low. This minimum concentration will also likely vary from system to system. The addition of 1%, or less, of Zn, Sn, Cu and to some extent In, allows the minimum temperature for optimum infiltration to be markedly reduced. The results show that Zn and Cu are more effective than Sn, but a combination of Sn and Zn may have some synergistic effect. The presence of the Al was detrimental, and the Bi, Ga or Sb had a minimal effect. Thus, the addition of some metals to the molten lead phase can have an antagonistic effect on infiltration. However, in the presence of a wetting element, minor amounts (0.5%) of these other elements can be tolerated. The state of the iron surface in the porous blanks is also very important. Satisfactory impregnation cannot be made to occur except at high temperatures if the iron shot are not well reduced. In the case of shot made from iron oxide the minimum infiltration temperature can be as much as 300° C higher than that for shot made from iron powder.

It is possible to have the iron phase initially as iron oxide and intermingle or layer on this iron oxide with the lead phase, and subsequently raise the temperature of the mixture to above about 500° C in a reducing atmosphere to effect reduction of iron oxide to iron, continuing to raise the temperature further as necessary to effect infiltration and densification.

EXAMPLE 18

Agglomerates, with diameter 0.130 inch, were made from a mixture of fine powders, comprising 45% wt. Domtar MP-81 iron powder and 55% $Fe_2O_3$ (supplied by Ferrox Iron Ltd., >99.5% $Fe_2O_3$). These wet agglomerates were then coated with a mixture of powders having the following composition:

Pb - 91.1% wt.; Sn - 6.8% wt.; Zn - 2.1% wt. The coated agglomerates were dried and sintered in $H_2$ at 950° C for 2 hours and then rapidly cooled to room temperature. Final density of shot: 8.6 ± 0.3 g/cc (91.5% of Theoretical density).

Instead of utilizing iron or iron oxide as powders, it is possible to use other forms of iron or iron oxide such as filaments, thin sheets etc. and to compact and shape such filaments or sheets into matrix form for infiltration with the lead phase. Steel wool in particular can be compressed to form a readily infiltrated iron matrix.

EXAMPLE 19

Small spheres were prepared by lightly rolling and compacting steel wool. These spheres were infiltrated with molten lead (99.5% Pb) at 850° C in a hydrogen atmosphere. The infiltrated shot were then separated from the molten bath and given a final finishing operation to improve sphericity.

Composition of finished shot: Fe- 8.0% wt.; Pb - 92.0% wt. Final Measured Density 11.1 ± 0.2 g/cc (Theoretical density 11.0 g/cc). The steel wool can be readily compacted to a greater extent giving a greater proportion of iron in the composite.

We claim:

1. Composite metal bird shot of substantially theoretical density and reduced toxicity comprising iron and lead wherein the iron is a separate phase in discrete or porous matrix form, surrounded and interpenetrated by the lead phase, the lead phase being selected from lead and lead alloyed with up to about 5% weight based on the composite of an alloying element aiding wetting of the iron surfaces, and wherein the separate iron phase is present in from about 25 to about 90% weight of the composite.

2. The composite metal bird shot of claim 1 wherein the separate iron phase is present in from about 40 to about 70% wt. of the composite.

3. The composite metal bird shot of claim 2 wherein an alloying element is present and selected from the group consisting of copper, zinc, tin, indium and mixtures thereof, and the lead phase intimately wets the iron surfaces.

4. The composite metal bird shot of claim 3 wherein the alloying element is present in about 0.5 to about 1.5% wt. of the composite.

5. The composite metal bird shot of claim 2 wherein the iron phase consists of iron particles which are in substantial contact with each other.

6. The composite metal bird shot of claim 2 wherein the iron phase is a porous matrix structure.

7. The composite metal bird shot of claim 3 wherein zinc is present together with either copper or tin.

8. The composite metal bird shot of claim 3 having the following composition:

iron phase in about 40 to about 70% wt. copper or tin in about 0.05 to about 1.5% wt., zinc in about 0.05 to about 1.5% wt., and the balance substantially all lead.

9. The composite metal bird shot of claim 3 comprising a sintered composite mixture of iron powder and lead alloyed powder, the iron being substantially unalloyed except at the surfaces thereof but wetted and bonded by an alloy of the other metals.

10. The bird shot of claim 9 containing a preformed nucleus surrounded by said iron phase surrounded and interpenetrated by said lead phase.

11. The composite metal bird shot of claim 1 compacted and shaped by mechanical means.

12. The bird shot of claim 9 wherein the lead phase is more concentrated toward the pellet surface.

13. The bird shot of claim 10 wherein the performed necleus is an iron core.

* * * * *